United States Patent [19]

Goplen et al.

[11] Patent Number: 4,872,528

[45] Date of Patent: Oct. 10, 1989

[54] MUFFLER CONSTRUCTION

[75] Inventors: Gary D. Goplen, Stoughton; Lawrence F. Iles, Madison, both of Wis.

[73] Assignee: Nelson Industries Inc., Stoughton, Wis.

[21] Appl. No.: 226,458

[22] Filed: Aug. 1, 1988

[51] Int. Cl.[4] ..... F01N 1/10

[52] U.S. Cl. ..... 181/228; 181/255; 181/258

[58] Field of Search ..... 181/212, 223, 228, 227, 181/241, 243, 252, 256, 258, 264, 282, 255

[56] References Cited

U.S. PATENT DOCUMENTS

| | | | |
|---|---|---|---|
| 1,575,657 | 3/1926 | Straussler . | |
| 1,922,848 | 8/1933 | Harley | 181/264 |
| 3,016,108 | 1/1962 | Myddelton . | |
| 3,112,007 | 11/1963 | Ludlow et al. . | |
| 3,243,010 | 3/1966 | Flynn | 181/256 |
| 3,406,501 | 10/1968 | Watkins . | |
| 3,675,398 | 7/1972 | Glarrizzo | 55/316 |
| 3,823,743 | 7/1974 | King | 181/258 X |
| 3,884,655 | 5/1975 | Coop | 55/276 |
| 4,530,418 | 7/1985 | Currie | 181/227 |
| 4,705,138 | 11/1987 | Reese | 181/212 |

*Primary Examiner*—Benjamin R. Fuller

*Attorney, Agent, or Firm*—Andrus, Sceales, Starke & Sawall

[57] ABSTRACT

A muffler construction having improved sound attenuation characteristics. A tapered tubular metal screen is disposed within the outlet conduit of a muffler and has a axis concentric with the axis of the conduit. The screen has a closed end preferably facing in a downstream direction with respect to gas flow, and the opposite open end of the screen is attached to the conduit. The screen acts to reduce the sound levels without increasing the overall size of the muffler and with a minimum increase of weight.

18 Claims, 1 Drawing Sheet

FIG. 1
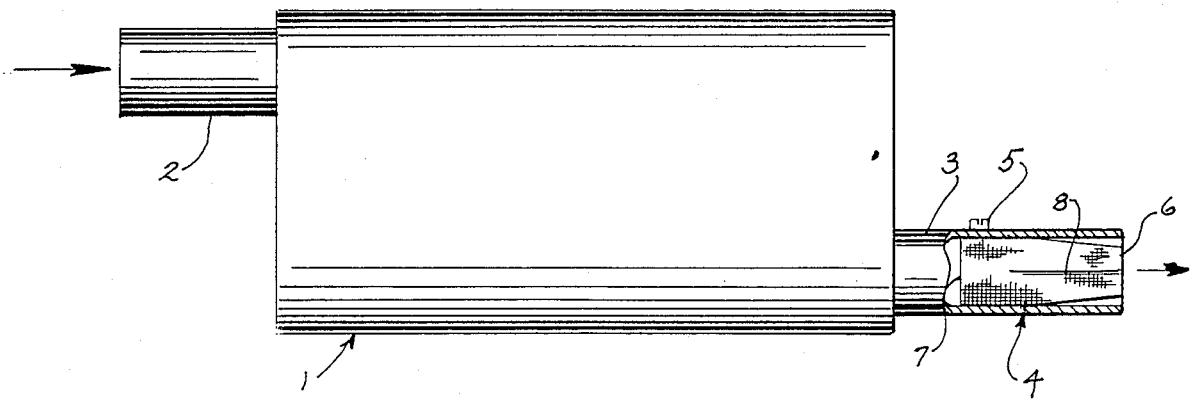
FIG. 2
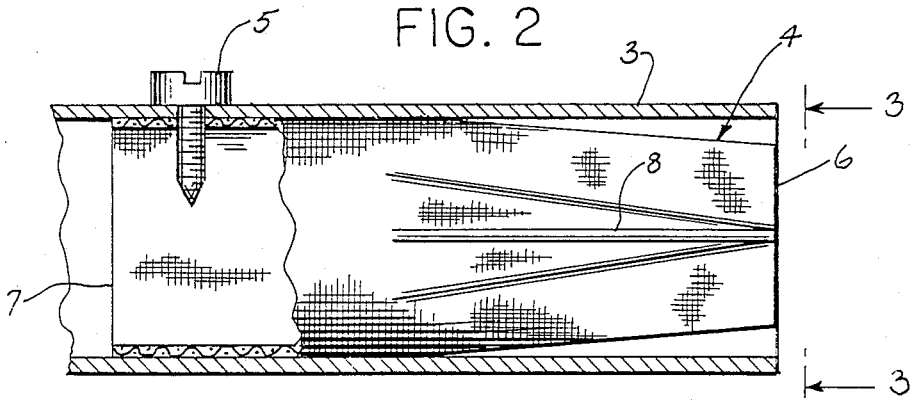
FIG.3
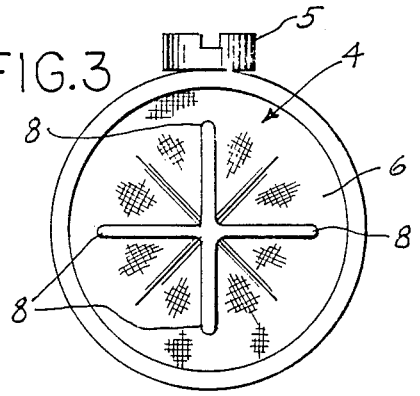
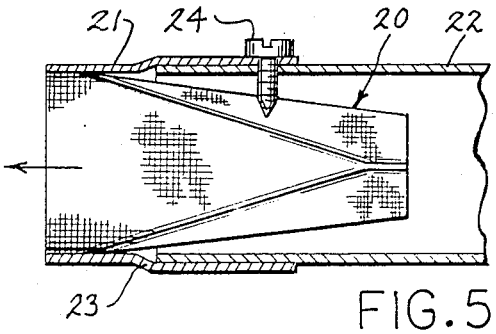
FIG.5
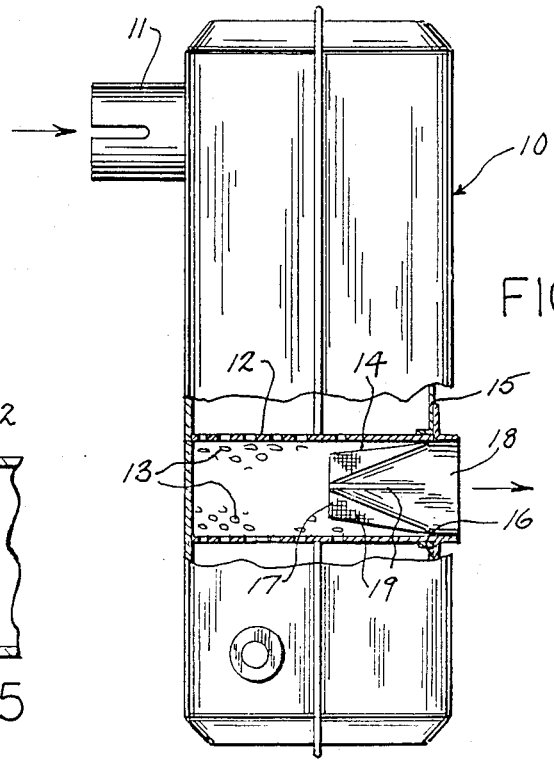
FIG.4

MUFFLER CONSTRUCTION

BACKGROUND OF THE INVENTION

There is a continuous desire to increase the sound attenuation characteristics of a muffler without increasing its overall size or weight and without an appreciable increase in restriction. In many applications, a muffler is designed to fit within certain space requirements and under these conditions the overall size of the muffler cannot be increased in an attempt to reduce sound levels. Further, attempts to increase the sound attenuation characteristics by the addition of internal baffling produces a corresponding increase in weight and cost as well as possibly increasing the restriction to flow.

SUMMARY OF THE INVENTION

The invention is directed to a muffler construction having improved sound attenuation characteristics. In accordance with the invention, a generally conical metal screen is disposed longitudinally within the outlet conduit of the muffler. The screen has a closed end preferably facing in a downstream direction with respect to gas flow, while the opposite open end of the screen is attached to the outlet conduit of the muffler.

In a preferred form of the invention, the closed end of the screen is formed by crimping an end of a tubular screen inwardly to bring end portions of the screen into contiguous relation, and then securing the contiguous portions, as by welding.

The screen is formed from a metal, such a stainless steel, and the openings in the screen preferably have a diameter less than 0.023 inches in which case the screen can also function as a spark arrester.

The screen provides a substantial reduction in sound level without increasing the overall size of the muffler and without appreciably increasing the weight. Further, the screen provides a minimum restriction to flow.

The screen is a relatively low cost item and can be removed and cleaned for reuse.

As an additional advantage, the screen acts to soften "after bang" which can occur when an unburned gas mixture ignites in the muffler after the engine is stopped. The "after bang" condition is common with small horsepower engines as used with lawn and garden equipment.

Other objects and advantages will appear in the course of the following description.

DESCRIPTION OF THE DRAWINGS

The drawings illustrate the best mode presently contemplated of carrying out the invention.

In the drawings:

FIG. 1 is a plan view of a typical muffler incorporating the silencing screen of the invention with the outlet conduit of the muffler broken away in section;

FIG. 2 is an enlarged plan view of the outlet conduit of the muffler with parts broken away in section;

FIG. 3 is a section taken along line 3—3 of FIG. 2;

FIG. 4 illustrates a modified form of the invention, utilized with an engine for small horsepower application; and FIG. 5 is a longitudinal section of an outlet pipe of a muffler incorporating the silencing screen of the invention.

DESCRIPTION OF THE ILLUSTRATED EMBODIMENT

FIG. 1 illustrates a typical muffler 1 for an internal combustion engine having an inlet conduit 2 and an outlet conduit 3. The internal construction of muffler 1 is not critical to the inventor and can take various forms.

In accordance with the invention, a generally tubular screen 4 is mounted in the downstream end of outlet conduit 3. As shown in the drawings, screen 4 is attached to conduit 3 by a screw 5 which extends through the conduit and is connected to the screen.

The downstream end 6 of screen 4 is closed off and the screen tapers longitudinally, with the opposite upstream end 7 of the screen being open and being connected to the conduit by the screw 5.

The downstream end 6 can be closed off in a manner as will be hereinafter described to provide a plurality of radially extending flutes 8 which are welded together to provide the closed end 6. In its completed form, screen 4 is generally conical in shape.

Screen 4 is formed of a metal, such as stainless steel, and preferably has a mesh size of approximately 30×30. As a feature of the invention, the screen 4, in addition to lowering sound levels, can also function as a spark arrester, and in this latter case, the openings in the screen should have a dimension or diameter less than 0.023 inches.

The tapered condition of screen 4 provides increased surface area and minimizes the restriction to flow. It is believed that the screen changes the flow pattern near the end of the outlet conduit 3 and prevents eddys from spilling out from the end of conduit 3, thereby reducing the sound level.

Tubular screen 4 can be fabricated from a flat sheet of screening which is initially rolled and welded in cylindrical shape. An end of the cylindrical screen is then crimped inwardly to provide the flutes 8, and the contiguous surfaces of the flutes are then spot welded to provide the closed end for the screen. The screen is then inserted within the outlet conduit 3 and attached therein by screw 5 or other attaching means.

In the embodiment of FIG. 4, the muffler 10 is a type to be used with small horsepower engines associated with lawn or garden equipment and the exhaust gas is introduced to the muffler through an inlet pipe 11 and is discharged through an outlet pipe 12, which is located within the confines of the muffler body. As in the case of the first embodiment, the internal construction of muffler 10 is not critical to the invention and can take various forms.

As illustrated, outlet conduit 12 is provided with a plurality of holes or perforations 13, through which the exhaust gas enters the outlet pipe and a generally conical screen 14, similar in construction and function to screen 4 of the first embodiment, is mounted within the downstream end of outlet conduit 12. The open large diameter end of screen 14 is spot welded or otherwise secured to the central flange 15 of annular disc 16 and the disc in turn is attached to the outer surface of muffler 10 by screws or the like.

The upstream end 17 of screen 14 is closed off, while the opposite downstream end 18 of the screen is open. The upstream end can be closed off in the manner as previously described by providing a plurality of radially extending flutes 19 which are welded together to provide the closed end.

The construction of FIG. 4, in which screen 14 is attached to disc 16, can be used as a retrofit installation for existing mufflers. In addition, FIG. 5 shows a further embodiment of the invention that can be employed as a retrofit to the outlet pipe of an existing muffler. In this embodiment, screen 20, similar in construction to screens 4 and 14, is secured within an adapter tube 21 and tube 21, in turn, can be connected to the outlet pipe 22 of a muffler. More specifically, the open end of screen 20 is spot welded or otherwise secured to the outer end of adapter tube 21, with the closed end of the screen facing upstream. Tube 21 is provided with an enlarged diameter inner section 23 which receives the outer end of outlet pipe 22. Screw 24 connects the overlapping tubes 21 and 22.

The construction of FIG. 5 provides a convenient manner of incorporating the screen 20 with the outlet pipe of an existing muffler.

While the closed end of the screen can be positioned either upstream or downstream with respect to the gas flow, it has been found that locating the closed end in a downstream direction provides the best balance of minimum restriction and maximum sound attenuation. As an example, a muffler associated with an engine operating under full load conditions at 3600 rpm and having a 1.25 inch O.D. outlet conduit, produced a sound level of 100.1 dba and a restriction of 15.6 inches of water. Incorporating a stainless steel screen having a mesh size of 30×30 and a length of 1.5 inches in the outlet conduit, with the closed tip of the screen facing downstream, produced a sound level of 95.9 dba, a reduction of 4.2 dba and a restriction of 18.2 inches of water, an increase of only 2.6 inches of water.

Although optimum performance is achieved by positioning the closed end of the screen in a downstream direction, improved performance is also obtained when the closed end is positioned upstream and in this latter case the screen is easier to manufacture and install particularly in retrofit applications, as shown in FIGS. 4 and 5.

While the drawings have illustrated the use of a generally conical screen having an open end, it is contemplated that in some installations a screen can be employed having a pair of opposed conical ends.

As shown in the drawings, the screen is preferably located in the outlet conduit of the muffler. In some installations the screen is positioned outside of the confines of the muffler, as shown in FIGS. 1–3, or alternately, as shown in FIG. 4, the screen, while mounted in the outlet conduit, may be located within the confines of the muffler itself.

In addition, various means can be employed to attach the screen to the outlet pipe.

The screen 4 provides a substantial reduction in sound levels for the muffler without increasing the overall size of the muffler and without appreciably increasing the muffler weight.

The screen can perform a dual function, not only reducing sound levels but serving as a spark arrester. As a spark arrester, the screen can be readily removed, cleaned and replaced for further use.

It has also been found that the screen can soften "after bang" explosions which frequently occur in small horsepower engines, such as used with lawn and garden equipment.

Various modes of carrying out the invention are contemplated as being within the scope of the following claims particularly pointing out and distinctly claiming the subject matter which is regarded as the invention.

We claim:

1. An improved muffler construction, comprising a muffler having an inlet to receive a gas and having an outlet conduit to discharge the gas, a generally conical metal screen disposed longitudinally within the conduit, said screen having a closed end and having a large diameter open opposite end disposed in engagement with the inner surface of said conduit, the interior of said conical screen being free of obstructions to gas flow.

2. The construction of claim 1, wherein said closed end faces in a downstream direction with respect to gas flow.

3. The construction of claim 1, wherein said closed end faces in an upstream direction with respect to gas flow.

4. The construction of claim 2, wherein said closed end is disposed adjacent the downstream end of said conduit.

5. The construction of claim 1, wherein said screen tapers inwardly from said open end to said closed end and is provided with a plurality of outwardly extending longitudinal flutes.

6. The construction of claim 1, wherein said screen is formed of stainless steel.

7. The construction of claim 1, wherein said screen has a mesh size of about 30×30.

8. The construction of claim 1, and including means for attaching said opposite end of the screen to said conduit.

9. An improved muffler construction, comprising a muffler body having an inlet to receive a gas and having an outlet conduit to discharge said gas, an annular adapter having an opening therein, a generally conical metal screen disposed longitudinally within the opening in the adapter, said screen having a closed end and having a large diameter open opposite end disposed in engagement with the inner surface of said adapter bordering said opening, the interior of said of said conical screen being free of obstructions to gas flow, and attachment means for attaching said adapter to said outlet conduit of the muffler.

10. The combination of claim 9, wherein said adapter is a tubular member disposed in overlapping relation with said outlet conduit.

11. The combination of claim 10, wherein said tubular member has a small diameter outer end and a large diameter inner end separated from said outer end by an internal shoulder, said outlet pipe disposed within said inner end and seated against said shoulder.

12. The combination of claim 9, wherein said adapter comprises a generally flat annular disc disposed against an external surface of said muffler, said attachment means attaching said disc to said external surface.

13. A method of improving the sound attenuation of a muffler, comprising the steps of forming a flat sheet of metal screening into cylindrical shape, crimping an end portion of the cylindrical screen to bring opposed portions of the end into contiguous relation and provide an inwardly tapered end section and a plurality of outwardly extending longitudinal flutes, joining the contiguous portions to provide a closed end for said tapered end section, and inserting said screen into an outlet conduit of a muffler.

14. The method of claim 13, wherein the step of joining said contiguous portions comprises welding said portions.

15. The method of claim 13, and including the step of attaching the end of said screen opposite of said closed end to said conduit.

16. The method of claim 13, and including the step of facing said closed end downstream in said conduit with respect to the direction of gas flow.

17. The method of claim 13, and including the step of facing said closed end upstream in said conduit with respect to the direction of gas flow.

18. The method of claim 13, and including the steps of mounting the tapered screen in an opening in an annular adapter, and securing said adapter to said muffler in a manner such that said tapered screen is disposed concentrically of said outlet conduit.

* * * * *